United States Patent [19]

Byers, Jr. et al.

[11] 4,349,319

[45] Sep. 14, 1982

[54] PRESSURE AND FLOW COMPENSATED CONTROL SYSTEM WITH CONSTANT TORQUE AND VISCOSITY SENSING OVER-RIDE

[75] Inventors: J. Otto Byers, Jr., Canfield; Donald A. Locher, Hubbard, both of Ohio

[73] Assignee: Commercial Shearing, Inc., Youngstown, Ohio

[21] Appl. No.: 171,896

[22] Filed: Jul. 24, 1980

Related U.S. Application Data

[63] Continuation-in-part of Ser. No. 771,672, Feb. 24, 1977, abandoned.

[51] Int. Cl.[3] ..... F04B 1/28

[52] U.S. Cl. ..... 417/222; 60/329; 60/450; 60/452

[58] Field of Search ..... 417/216, 218–222, 417/310, 212; 60/450, 445, 428, 452, 329

[56] References Cited

U.S. PATENT DOCUMENTS

| | | | |
|---|---|---|---|
| 2,238,061 | 4/1941 | Kendrick | 60/450 X |
| 2,835,228 | 5/1958 | Parr et al. | 417/222 X |
| 3,051,092 | 8/1962 | Lambeck | 417/219 |
| 3,732,036 | 5/1973 | Busbey et al. | 417/216 |
| 4,212,596 | 7/1980 | Ruseff | 417/222 X |

*Primary Examiner*—Robert E. Garrett
*Assistant Examiner*—Edward Look
*Attorney, Agent, or Firm*—Buell, Blenko, Ziesenheim & Beck

[57] ABSTRACT

A variable displacement fluid pump system is provided having a pressure and flow compensated control system with constant torque and viscosity sensing over-ride acting on the control system. The system includes a viscosity sensing means receiving fluid from the pump and acting on the control means to over-ride the control means to reduce the pump displacement when the viscosity of fluid in the pump exceeds a predetermined value, a pressure sensing means receiving fluid from the pump acting on the control means to over-ride the control means and reduce pump displacement when the pressure in the system exceeds a predetermined value, at least one pressure compensated work port valve receiving pressure fluid from said pump and a variable by-pass valve receiving fluid from the pump not required by the pressure compensated work port valves to variably by-pass excess fluid from said pressure compensated valve and acting on said control means to vary the displacement of said variable displacement pump to satisfy the fluid requirements of said pressure compensated valve above a minimum established flow rate.

11 Claims, 5 Drawing Figures

PRESSURE AND FLOW COMPENSATED CONTROL SYSTEM WITH CONSTANT TORQUE AND VISCOSITY SENSING OVER-RIDE

This application is a continuation-in-part of our copending application Ser. No. 771,672 filed Feb. 24, 1977, now abandoned.

This invention relates to a pressure and flow compensated control system with constant torque and viscosity sensing over-ride and particularly to a control system for variable displacement fluid pumps such as, for example, swash plate pumps.

The problems of controlling flow rate in response to multiple signals in hydraulic systems have long been recognized. Similarly the problems created in variable displacement pumps and particularly piston pumps by excessive fluid viscosities are well known, for example, if the viscosity is too great at start up with the pump set for maximum displacement serious damage may be done to the pump. Prior to this invention, there were no satisfactory solutions to these problems and such solutions as were proposed were haphazard and unreliable.

The present invention provides a pressure and flow compensated control system with constant torque and viscosity sensing over-ride means to provide the exact pressure and flow rate required by operating conditions as well as protection for the system.

We provide a variable displacement fluid pump system having preferably a variable displacement pump, displacement control means varying the displacement of said pump, pressure and flow compensated control system receiving fluid from said pump for delivery to a hydraulic work element such as a cylinder or motor, constant torque means and viscosity sensing over-ride means acting on the displacement control system, said system including viscosity sensing means receiving fluid from the pump and acting on the displacement control means to over-ride the displacement control means to reduce the pump displacement when the viscosity of fluid in the pump exceeds a predetermined value, a pressure sensing means receiving fluid from the pump acting on the control means to over-ride the control means and reduce pump displacement when the pressure in the system exceeds a predetermined value, at least one pressure compensated work port valve receiving pressure fluid from said pump and a variable by-pass valve receiving fluid from the pump not required by the pressure compensated work port valves to variably by-pass excess fluid from said pressure compensated valve and acting on said displacement control means to vary the displacement of said variable displacement pump to satisfy the fluid requirements of said pressure compensated control system above a minimum established flow rate. Preferably, the viscosity sensing means, which may be used with other types of valve assemblies such as open center valves etc., comprises an elongated passage sensitive to viscosity connected to and delivering fluid from one side of the displacement control means and a flow control device, such as a sharp edge orifice, substantially unaffected by viscosity connected to and delivering fluid to the opposite side of said control means whereby to position the control means for minimum pump displacement when fluid viscosity is above a predetermined value and to permit free variable pump displacement when the fluid is below said predetermined value. Preferably the variable by-pass valve is normally resiliently biased to connect fluid from the pump to the work valves and the bias is overcome by fluid pressure from the pump to by pass fluid to a tank when the work valves are closed while maintaining a minimum established flow from said pump.

In the foregoing general description of our invention we have set out certain objects, purposes and advantages. Other objects, purposes and advantages will be apparent from a consideration of the following description and the accompanying drawings in which.

Figure 1:
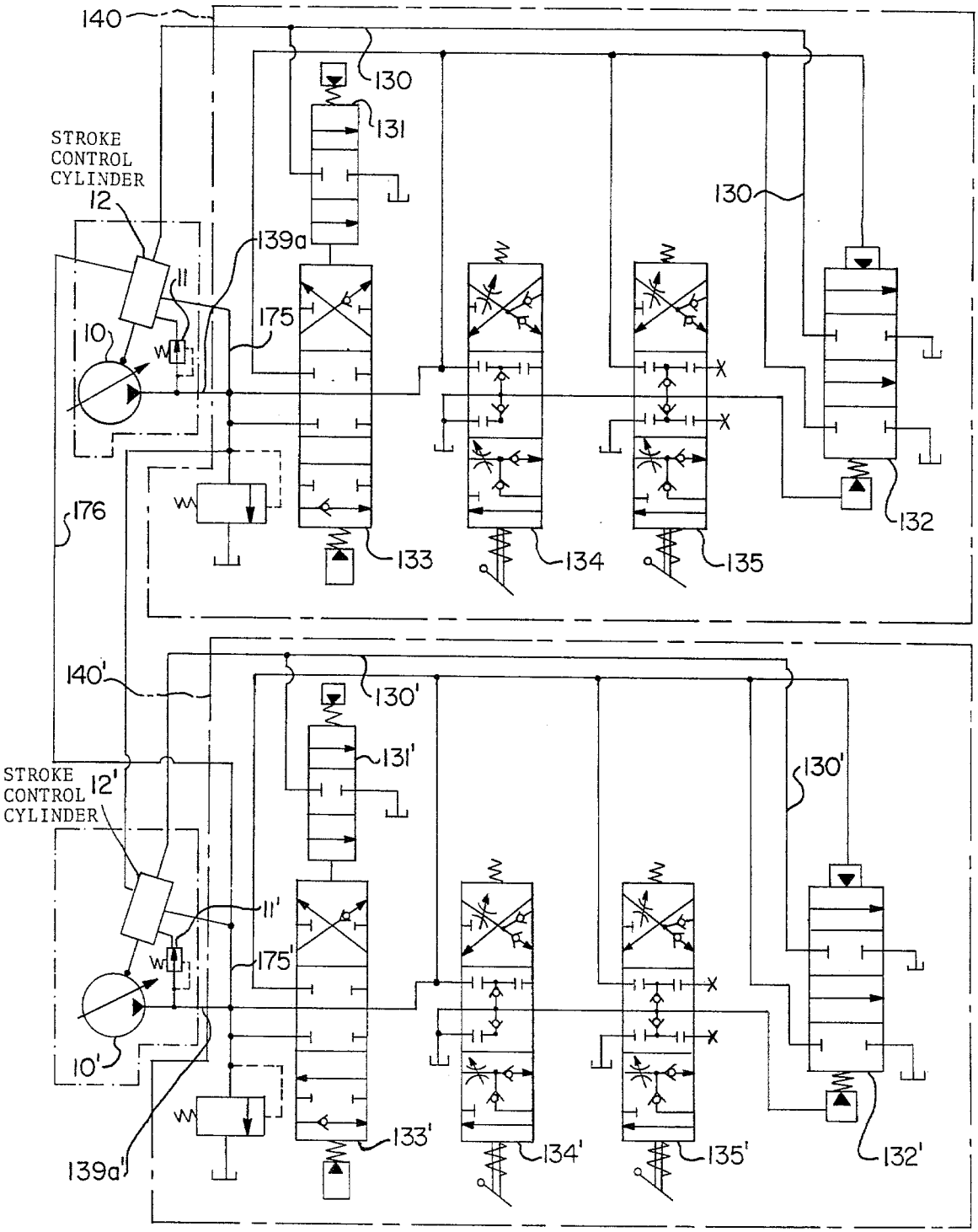
FIG. 1 is a schematic of a system according to our invention.

Referring to the drawings we have illustrated a pressure and flow compensated control system with a constant torque and viscosity sensing over-ride made up of a pair of variable displacement pumps 10 and 10' of the swash plate type, each having a pump stroke control cylinder 12 and 12'. We shall describe the operation of only one pump 10 of this system, the operation of the other pumps is identical.

Control pressure is fed from pump 10 through pressure reducing valve 11 through passages 101 and 106 (FIG. 4) to cavity 107 of the control cylinder 12, where it acts on area 103 of servo piston 102 at all times. Area 104 is larger than area 103. As servo spool 105 moves to the right, control flow is passed through passage 106 to annulus 107, through hole 108 to annulus 109 over land 110 through passage 111 to cavity 112, and acts on area 104 causing the servo piston 102 to move to the right by overcoming friction, pressure forces in the pump, and the force due to pressure acting on area 103 of servo piston 102. Piston 102 is connected to connecting link **115*b* which is connected to swash plate 115*c* of variable displacement pump 10. As the servo piston 102 moves to the right, the pump's displacement is decreased. Servo piston 102 continues to move to the right until land 110 again covers passage 111. Servo piston 102 will remain in this position and the pump displacement will remain constant until servo spool 105** moves either to the right or left.

If the force due to pressure acting on area 129 of servo spool 105 is removed, spring 113 causes spool 105 to move to the left. As spool 105 moves to the left, land 110 uncovers passage 111 communicating cavity 112 to low pressure through passage 114. Pressure acting on area 103 causes servo piston 102 to move to the left, increasing the pump's displacement. Servo piston 102 continues to move to the left until land 110 again covers passage 111. Servo piston 102 will remain in this position until spool 105 moves either to the right or to the left.

The pump's swash plate angle and therefore displacement is controlled by the position of the servo piston 102 through link **115*b* attached to swash plate 115*c*. Servo piston 102 is, in turn, controlled by the position of servo spool 105. The system described in this patent has four (4) means of controlling the position of the servo spool 105 and each will be described in detail but generally, the servo spool 105 is moved hydraulically by having hydraulic pressure acting on area 129 to balance, overcome, or be overcome by, spring 113 acting on the opposite end of servo spool 105. The following control modes cause the pressure acting on area 129 to change, and can therefore position servo spool 105** and, in turn, change the pump's displacement. These are: (1) Constant torque control, (2) Viscosity sensing control, (3) Pressure compensator over-ride, (4) Load sensing control signalled from the 4-way directional valves. The actual pump displacement will be the smallest displacement required by any of the above 4 control modes.

Constant Torque Control Mode

Figure 5:
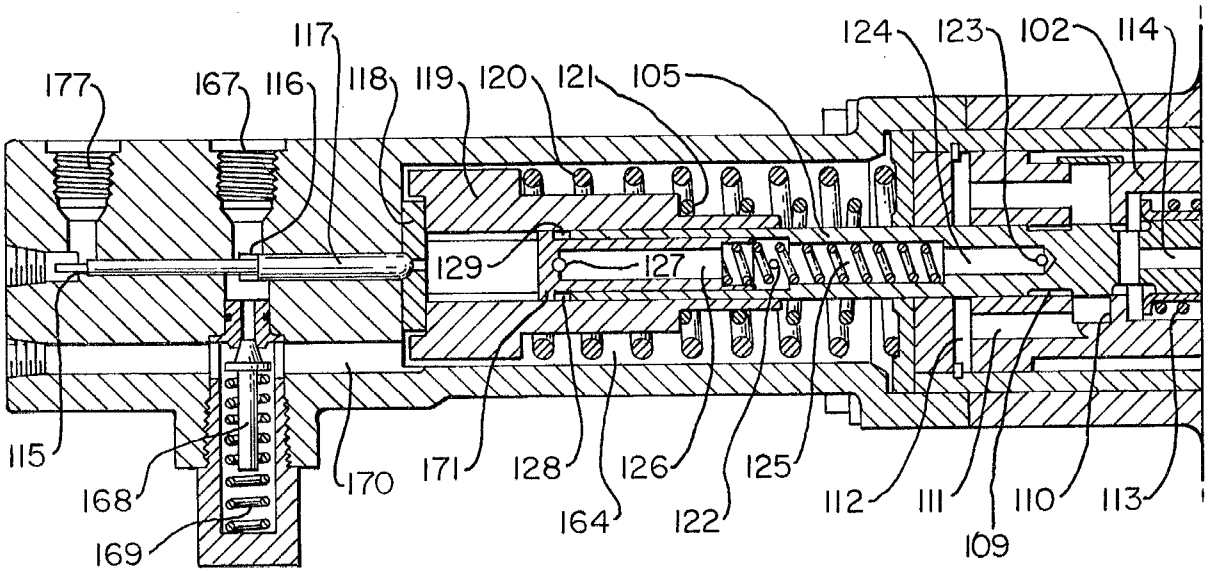
FIG. 5 is a section on the line V—V of FIG. 3 showing pressure compensating and constant torque control mechanisms.

Pressure from pump 10 (FIG. 1) is communicated through line 175 to port 167 of stroke control 12 (FIG. 5). Pressure is also communicated from pump 10' through line 176 (FIG. 1) to port 177 of stroke control cylinder 12.

Pressure acting on areas 115 and 116 of piston 117 causes piston 117, bar 118 and retainer 119 to move against springs 120 and 121. Piston 117 sums the forces caused by the pressure acting on areas 115 and 116 and acting against springs 120 and 121 to provide a signal for varying pump displacement as a function of the pressures acting on areas 115 and 116.

Figure 4:
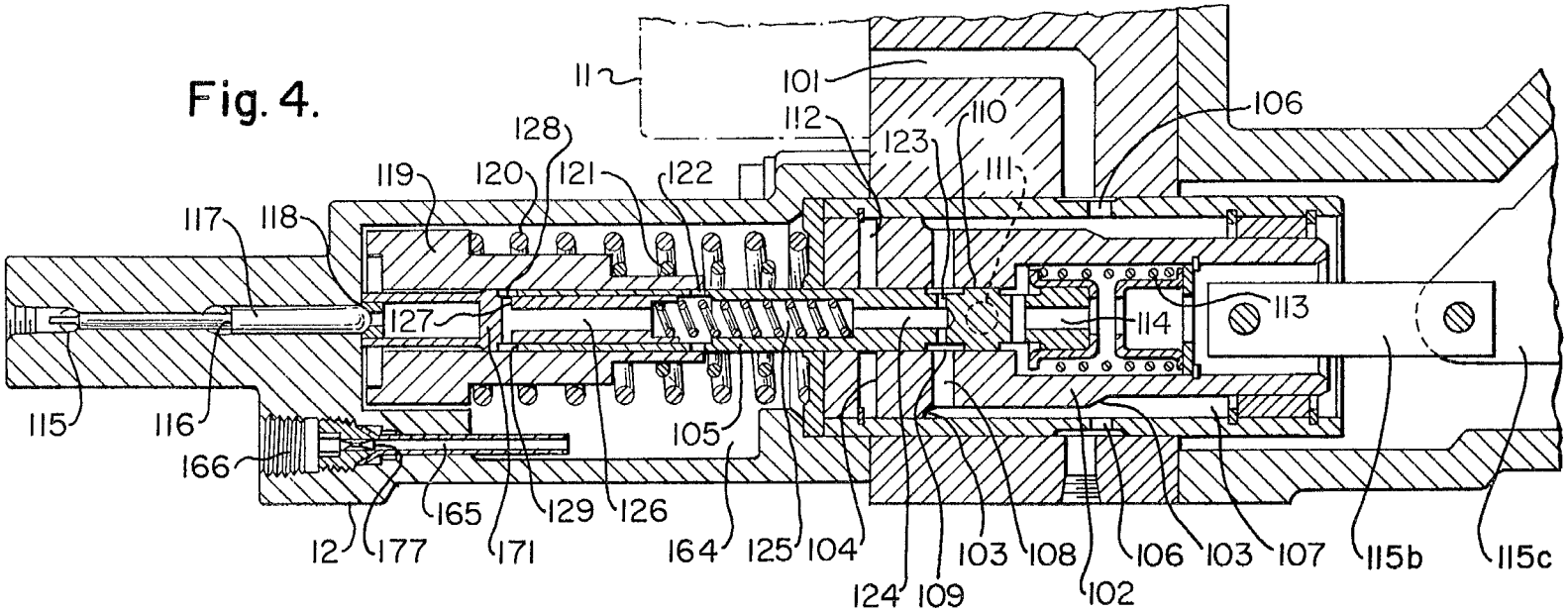
FIG. 4 is a section on the line IV—IV of FIG. 3, and shows the viscosity sensing control.
Figure 3:
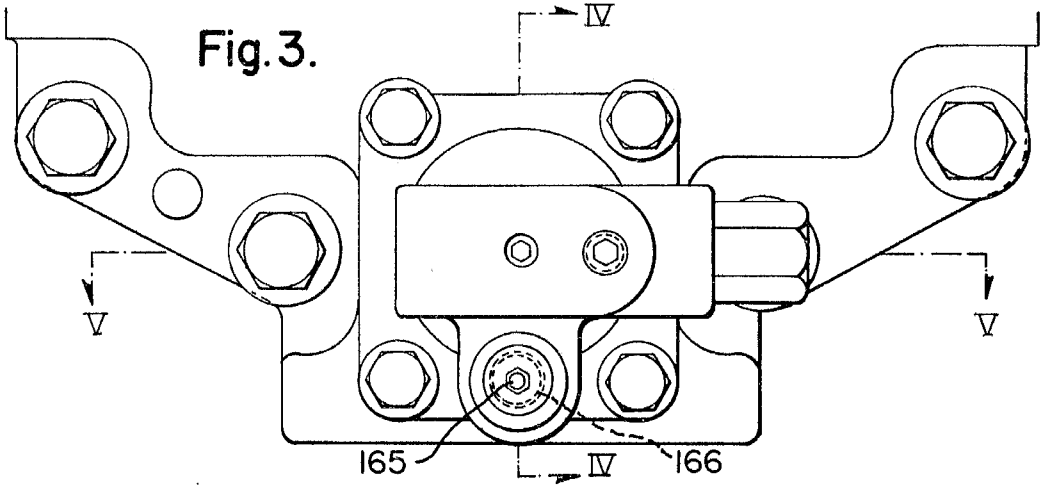
FIG. 3 is an end elevation of the torque, viscosity and pressure compensated over-ride control of this invention.

As retainer 119 moves against springs 120 and 121, retainer 119 covers hole 122. When hole 122 is covered, control pressure is communicated from annulus 109 through orifice 123 and passage 124 to cavity 125, through passage 126 and hole 127 to annulus 128 where it acts on area 129. Pressure acting on area 129 causes spool 105 to move to the right until hole 122 is again uncovered sufficiently that the pressure drop through hole 122 causes pressure acting on area 129 to balance spring 113. Flow now passes through hole 122 into cavity 164 and through viscosity sensitive passage 165 to port 166 (FIG. 4). The pump's displacement is therefore adjusted inversely proportional to the combination of pressures at areas 115 and 116.

It can now be seen that the displacement of both pumps 10 and 10' will be changed approximately the same percentage as a result of pressures acting on areas 115 and 116 on 115' and 116'.

Viscosity Sensing Control

If the fluid viscosity is too high, the pressure drop through passage 165 will be sufficient, when acting on area 129, to cause spool 105 to move to the right against spring 113. This is true because the pressure drop across flow control device 123, which may be, for example, a sharp edged orifice, is little affected by viscosity. The pressure drop through passage 165 is very sensitive to viscosity. As spool 105 moves to the right, the pump's displacement decreases to a predetermined minimuim value. As the temperature of the fluid increases, its viscosity decreases. At a predetermined viscosity, the pressure drop across passage 165 is no longer sufficient to hold spool 105 against spring 113 and the pump's displacement returns to the maximum value.

Pressure Compensator Over-Ride (FIG. 5)

Port 167 is connected to output pressure of pump 10 as described above. In addition to acting on area 116, pressure also acts against poppet 168 and spring 169. When pump output pressure overcomes the preload on spring 169, flow enters cavity 164 through passage 170. When the flow into cavity 164 from orifice 123 through hole 122 plus the flow past poppet 168 through passage 170 are sufficiently large to saturate orifice 177 (FIG. 4), the pressure in cavity 164 rises until it is sufficient when acting on area 129, to cause spool 105 to move to the right. Spool 105 moves to the right until either the pressure at port 167 reduces to the preset level or the pump's displacement is at the predetermined minimum value. This provides the pressure compensated over-ride.

Load Sensing Control Signaled form the 4-Way Directional Valves

Port 166 of stroke control 12 is connected by line 130 (FIG. 1) to port 179 of valve 131 (FIG. 2) and to port **130*b* of valve 132. If valve 133, 134, and 135 are all in neutral, valves 131 and 132 will block flow from port 166 and the pressure will increase on area 129 of spool 105 until spool 105** moves to the right causing pump displacement to decrease to a predetermined minimum value.

The functions of valves 132, 134 and 135 are explained in U.S. Pat. No. 3,565,110; however, an additional function has been added to valve 132 therefore the functions will be described again here.

The operation of the by-pass valve 132 and consequently valves 133–135 may be more fully explained as follows. Area 141 (FIG. 2) is connected by passage 200 to holes 201 to system pressure from conduit 172. Cavity 143 is connected by passage 202 to annulus 203 to passage 162 to passages 159 and/or 161 depending on the position of valve 135. If it is in the neutral position, as shown, both passages 159 and 161 connect to annulus 149 and 150, to passage 158. If valve 134 were in neutral also, not shown, passage 158 would connect to annulus 206 and 207 to passage 144 and to system return by passages 178 and 147. In this case, spring 142 will balance system pressure on area 141 and thereby restrict pump flow from conduit 172 through holes 204 across lands 153 to return passage 147 to a predetermined level. This level must be sufficient to act as "control pressure" to act on areas 104 and 103 (FIG. 4) to control the pumps 10 or 10' displacement as desired in the system shown in FIG. 1. During this mode of operation, land 154 will be closed, blocking flow from passage **130*a* and port 130*b***.

Figure 2:
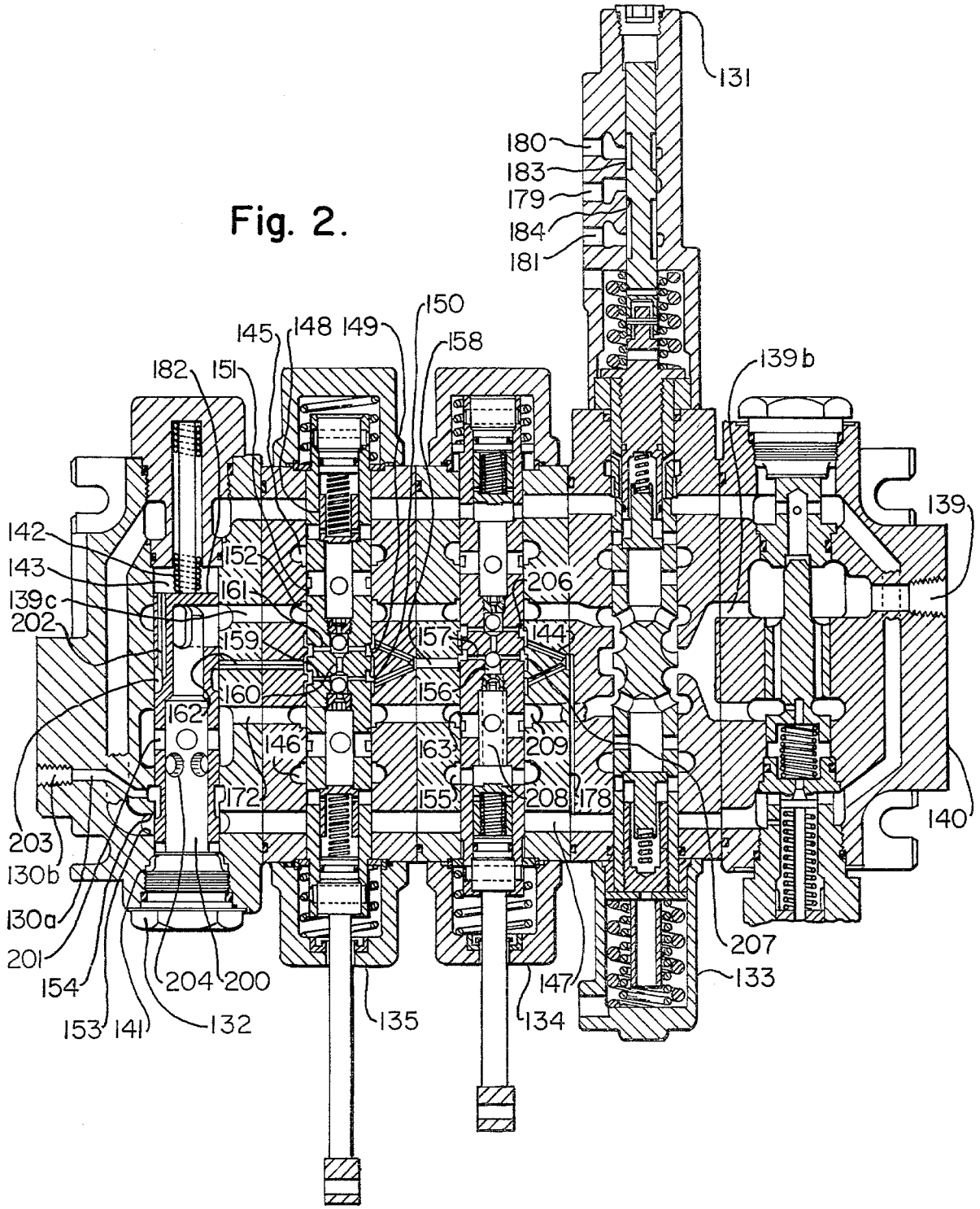
FIG. 2 is an enlarged section through the inlet sections, work section and outlet section of the valve system of FIG. 1.

When either valve 134 or 135 is shifted as shown by valve 134 in FIG. 2 the cavity 143 at the end of valve 132 will be blocked from return passage 144. Cavity 143 will instead be connected through passage 156, to passage 208. Flow from pump 10 will now pass through line **139*a* to port 139 through passages 139*b*, 139*c*, 200 through hole 201 to passage 172 and across hole 209 into the passage 208. Since valve 132 now has system pressure from passage 172 acting on area 141 and pressure from passage 208 of valve 134 through passages 156, 158, 150, 159, 162 and 202 acting on area 182, the balance on valve 132** is as follows:

$P_1A_1 = P_2A_2 + F_s$ $P_1$ = pressure in passages **139*c* and 172**

$A_1$ = area 141

$P_2$ = pressure in passage 208

$F_s$ = force of spring 142

It can now be seen that valve 132 is so arranged as to maintain a constant pressure differential between passages 172 and 208.

It is now clear that the flow rate into cavity 208 will be proportional to the area of holes 209 that is open to passage 172. The flow into passage 208 is now proportional to the position of valve 134 regardless of the actual level of pressure required at passage 208.

When passage 144 is blocked as either valve 134 or 135 is shifted, the pressures $P_1$ and $P_2$ will be equal and spring 142 will cause valve 132 to start to shift such that land 153 restricts flow from passage 172 to return passage 147. This will cause system pressure to increase until it is equal to the pressure required at cylinder port 155, and continue to increase until $P_2$ is sufficiently lower than $P_1$ to satisfy $P_1A_1=P_2A_2+F_s$.

The pressures in passages 172 and 208 act on areas 141 and 182, respectively such as to cause all excessive predetermined minimum flow from pump 10 to by-pass across land 153 of valve 132 to return passage 147.

The function of the valve assembly 140 as described so far is the same as in U.S. Pat. No. 3,565,110. When the area of holes 209 is such as to require more flow to maintain the fixed pressure differential across valve 132 described above, valve 132 will continue to move down until land 154 starts to open to return passage 147. This allows flow from cavity 164 in control cylinder 12 to pass through passage 165, orifice 177, port 166 through line 130 to port **130*b* on valve 132 (FIG. 2) through passage 130*a* and over land 154. This causes pressure in cavity 164 acting on area 129 of servo spool 105 to decrease until spring 113 (FIG. 4) moves servo spool 105 to the left causing servo piston 102 to move to the left thereby increasing pump displacement as described above. The pump's displacement will continue to increase delivering higher flow rates through line 139*a* to port 139 on valve 140 to passages 139*b*, 139*c*, 200 through hole 201 to passage 172. This flow will continue to increase until the pressure differential between passages 172 and 208 is sufficient to overcome spring 142. At this point, valve 132 will be balanced and land 154 will restrict flow form control cylinder 12, cavity 164 such that pressure acting on area 129 of servo spool 105 will balance spring 113. The pump's displacement will remain at this value until an inbalance again occurs at valve 132**.

It can be seen that either valve 134 or 135 shifted in either direction will provide the same signal to cavity 143 and affect both valve 132 and control cylinder 12 the same as described above.

Pump 10' and valve 140' function the same as pump 10 and valve 140. The only connection between the two systems is the pressure summing provided by area 115 and 116 on control cylinder 12 and by areas 115' and 116' on control cylinder 12'. This feature insures that the two pumps' displacements vary as a function of both system pressures in order to maintain substantially constant torque output from the prime mover which drives both pumps.

Port 166 on control cylinder 12 is also connected through line 130 to port 179 of valve 131 (FIG. 2). When valve 131 is in the neutral position as shown, flow from port 166 of control cylinder 12 will be blocked thereby increasing pressure in cavity 164 acting on area 129 of servo spool 105. This pressure will increase until spring 113 is overcome. As described above, the pump's displacement is now controlled by valve 132.

When valve 131 is shifted in either direction, not shown, flow will pass from port 166 on control cylinder 12 through line 130 into port 179 in valve 131 over either land 183 or 184 to either tank return passage 180 or 181. This causes pressure in cavity 164 to decrease, thereby causing the pump's displacement to increase to maximum displacement as described above. Valve 132 can no longer control pump displacement, but will continue to function to by-pass flow not required at valves 134 or 135.

The valve 132 in this system acts as a variable by-pass valve for the pressure compensated valves 134 and 135 and also as a signal device to signal, stroke control 12 of the variable displacement pump 10 to increase the flow rate if that is the only way to satisfy the flow requirement of the pressure compensated valves.

The arrangement shown in FIGS. 4 and 5 for summing signals to the pump 11 is unique. If pressure in cavity 128 is reacted against spring retainer 119, the piston 117 will be required to act against springs 120 and 121 plus a variable force from a variable pressure acting in cavity 128. This will cause a variable arc in the pressure vs. displacement curve. In the arrangement shown in FIGS. 4 and 5, pressure in cavity 128 reacts against piston 171 and against the control housing. Force from piston 117 is transmitted through bar 118 to retainer 119 and springs 120 and 121. In this way, pressure in cavity 128 is prevented from interfering with the relationship between the force on piston 117 and springs 120 and 121.

In the foregoing specification we have set out certain preferred practices and embodiments of our invention, however, it will be obvious to men skilled in the art that this invention may be otherwise embodied within the scope of the following claims.

We claim:

1. A variable displacement fluid pump system comprising a variable displacement pump, displacement control means varying the displacement of said pump, viscosity sensing means receiving fluid from said pump acting on said control means to over-ride said control means and reduce the pump displacement when the viscosity of the fluid in the pump exceeds a predetermined value, pressure sensing means receiving fluid from said pump acting on said control means to over-ride said control means and reduce the pump displacement when the pressure in the system exceeds a predetermined value, at least one pressure compensated work port valve receiving pressure fluid from said pump to deliver said pressure fluid selectively to a hydraulic work element and a variable by-pass valve receiving pressure fluid from the pump not required by the pressure compensated work port valve to variably by-pass excess fluid from said pressure compensated valve and acting on said control means to vary the displacement of said variable displacement pump to satisfy the fluid requirements of said pressure compensated valve above a minimum established flow rate.

2. A variable displacement fluid pump system as claimed in claim 1 wherein the viscosity sensing means comprises an elongate passage sensitive to viscosity connected to and delivering fluid from one side of the displacement control means and a flow control means substantially not affected by viscosity connected to and delivering fluid to the opposite side of said control means whereby to position the control means for minimum pump displacement when fluid viscosity is above a predetermined value and to permit free variable pump displacement when the fluid does not exceed said predetermined value.

3. A variable displacement fluid pump system as claimed in claim 2 wherein the flow control device is a sharp edge orifice.

4. A variable displacement fluid pump system as claimed in claim 1 wherein the variable by-pass valve is normally resiliently biased to connect fluid from the pump to the work valves and the bias is overcome by fluid pressure from the pump to by-pass fluid to a tank when the work valves are closed maintaining a minimum established flow rate in the system.

5. A variable displacement fluid pump system as claimed in claim 1 wherein the variable by-pass valve acts on the displacement control means to change pump displacement so as to maintain a minimum by-pass flow in all positions of the work port valves.

6. A variable displacement fluid pump system as claimed in claim 1 wherein the fluid pump is a swash plate pump.

7. A variable displacement fluid pump system as claimed in claim 6 wherein the displacement control means acts to stroke the swash plate to regulate the displacement of the pump.

8. A variable displacement fluid pump system as claimed in claim 6 wherein the viscosity sensing means acts on the displacement control means to hold the swash plate at substantially zero displacement so long as the fluid viscosity is above a predetermined value.

9. A viscosity sensing means for controlling the displacement of variable displacement fluid pumps comprising a fluid control means controlling displacement of said pump, an elongated passage sensitive to viscosity connected to and delivering fluid from one side of the displacement control means and flow control means substantially not affected by viscosity connected and delivering fluid to the opposite side of said fluid control means whereby to position the fluid control means for minimum pump displacement when fluid viscosity is above a predetermined value and to permit free variable pump displacement when the fluid does not exceed said predetermined value.

10. A viscosity sensing means as claimed in claim 9 wherein the control means is a piston.

11. A viscosity sensing means as claimed in claim 9 wherein the flow control means is a sharp edge orifice.

* * * * *